US005925505A

United States Patent [19]

Baugher et al.

[11] Patent Number: 5,925,505

[45] Date of Patent: Jul. 20, 1999

[54] DIRECT X-RAY ELEMENTS CAPABLE OF HANDLING IN AMBIENT LIGHT

[75] Inventors: Jeffrey S. Baugher, Rochester; Robert E. Dickerson, Hamlin; Alan S. Fitterman, Rochester, all of N.Y.

[73] Assignee: Eastman Kodak Company, Rochester, N.Y.

[21] Appl. No.: 09/087,477

[22] Filed: May 29, 1998

[51] Int. Cl.[6] ..... G03C 1/46

[52] U.S. Cl. ..... 430/502; 430/966; 430/603; 430/517; 430/522; 430/606; 378/168; 378/185

[58] Field of Search ..... 430/966, 603, 430/502, 517, 522, 606; 378/168, 185

[56] References Cited

U.S. PATENT DOCUMENTS

| | | | |
|---|---|---|---|
| 2,379,383 | 6/1945 | Murray | 430/513 |
| 2,542,304 | 2/1951 | Boucher | 430/495.1 |
| 3,963,497 | 6/1976 | Kosti | 430/522 |
| 5,098,818 | 3/1992 | Ito et al. | 430/517 |
| 5,370,977 | 12/1994 | Zietlow | 430/502 |

OTHER PUBLICATIONS

Research Disclosure, Sep. 1996, No. 389, Item 38957, IV. Chemical Sensitization.

*Primary Examiner*—Janet Baxter
*Assistant Examiner*—Amanda C. Walke
*Attorney, Agent, or Firm*—Carl O. Thomas

[57] ABSTRACT

Direct X-ray films are disclosed capable of being handled in room light prior to and during processing. The films contain silver halide grains responsive to X-radiation that are sulfur sensitized. The films also contain a combination of processing solution bleachable dyes chosen to provide prior to processing (a) an average density of greater than 3.0 over a first, continuous spectral sensitivity range extending from a minimum wavlength of 320 nm over which the silver halide grains exhibit an absorption coefficient of at least 0.5 $cm^{-1}$ and (b) a density of greater than 3.0 throughout a second spectral range including wavelengths of from 600 to 650 nm.

10 Claims, No Drawings

DIRECT X-RAY ELEMENTS CAPABLE OF HANDLING IN AMBIENT LIGHT

FIELD OF THE INVENTION

The invention is directed to silver halide imaging elements that respond to incident X-radiation image patterns.

BACKGROUND

The internal structure of objects that are light impenetrable, running the gamut from the human body to turbine blades and pipe-line welds, can be non-destructively examined, by impinging X-radiation uniformly on the object and recording the image pattern of X-radiation that emerges from the object.

Radiographic elements containing silver halide grains are commonly used for recording X-radiation images. In the indirect approach, which accounts for the majority of medical diagnostic imaging, the X-radiation is absorbed primarily by a fluorescent intensifying screen. Phosphor particles in the screen absorb X-radiation and emit light that is in turn absorbed by the silver halide grains in a radiographic element to form a developable latent image. In this approach the silver halide grains are spectrally sensitized so that the peak sensitivity of the grains matches the principal emission peak of the phosphor particles.

In the direct approach, absorption of the X-radiation by the silver halide grains is relied upon to produce a latent image that can then be converted to a viewable form by processing (e.g., development and fixing).

In both direct and indirect radiographic imaging the imaging sensitivity (i.e., speed) is increased by chemically sensitizing the silver halide grains. Sulfur and gold sensitizers, singly and, most commonly, together are employed. Common chemical sensitizers for silver halide grains are summarized in *Research Disclosure*, Vol. 389, September 1996, Item 38957, IV. Chemical sensitization. *Research Disclosure* is published by Kenneth Mason Publications, Ltd., Dudley House, 12 North St., Emsworth, Hampshire P010 7DQ, England.

About 10 times more X-radiation is required to produce a latent image by direct X-radiation exposure than by indirect X-radiation exposure. In medical diagnostic imaging direct X-radiation imaging is confined to applications where only low levels of X-radiation exposure are required and use of indirect X-radiation imaging is inconvenient. For example, in dental diagnostic imaging a small piece of X-ray film, commonly referred to as a "chip", mounted in a sealed opaque package, is placed in the patient's mouth during X-ray exposure. The oral location of the film during exposure renders the use of intensifying screens difficult and, when the small area of exposure and therefore small benefit to be gained is taken into account, impractical.

X-radiation imaging of inanimate objects, commonly labeled industrial X-ray imaging, usually does not have the same level of object sensitivity to X-radiation as medical diagnostic imaging. Hence, direct X-ray imaging of objects such as turbine blades and pipe line welds is quite common.

Both direct and indirect imaging radiographic elements that rely on silver halide for latent image formation are light sensitive. Since indirect silver halide radiographic elements are intended to respond to light emitted by one or two intensifying screens and are usually spectrally sensitized, it is readily apparent that these elements must be sensitive also to ambient light. Although direct radiographic elements are intended to record only X-radiation and cannot benefit from spectral sensitization, the silver halide grains have native sensitivity extending from the near ultraviolet into the visible spectrum. The hydrophilic colloid, such as gelatin, suspending the silver halide grains provides radiation exposure protection for wavelengths up to 320 nm, but the native sensitivity of the grains to wavelengths longer than 320 nm causes objectionably increased minimum density levels when inadvertent exposure to ambient light occurs.

Medical X-ray clinics have little difficulty with protecting radiographic elements from light exposure prior to and during processing. The radiographic film is protected from room light by enclosure in a cassette during exposure and handling, and standard equipment exists for the dark loading of the film into the cassette and the dark removal of the film from the cassette for processing in a light sealed rapid access processor.

However, for many other users the necessity of protecting the radiographic element from ambient light until processing is completed is burdensome. For example, in dental diagnostic imaging, following exposure, the dentist or dental technician must leave the patient and retreat to a separate room equipped with safelights to remove the dental film chip from its opaque package and complete processing to a viewable image. Leaving the patient is an inconvenience and maintaining a separate room equipped with safelights is a major expense.

In industrial radiography the direct X-ray film is exposed in a light-tight container. The light-tight container is removed and processing is completed under safelights. Often in industrial radiography it is not feasible to bring the object to the X-ray examination equipment. Thus, for imaging a service truck providing a dark room containing a processor is required.

Attempts to integrate light exposure protection into direct X-ray films are known, but have not been accepted. For example, Murray U.S. Pat. No. 2,379,373 discloses overcoating the emulsion layers of direct X-ray films with carbon black in a casein and gelatin vehicle that can be removed during processing. Boucher U.S. Pat. No. 2,542,304 discloses laminating strippable opaque layers over the surface of the emulsion layers in direct X-ray films. Little, if any, commercial use of these approaches has occurred.

RELATED APPLICATION

Baugher et al U.S. Ser. No. 09/007,085, filed Jan. 14, 1998, titled DIRECT DENTAL X-RAY FILMS ADAPTED FOR ROOM LIGHT HANDLING, commonly assigned, discloses a direct X-ray dental film that, following imagewise exposure, can be removed from its opaque package and processed in room light. The film is comprised of emulsion and protective layers that contain dye particles which can be decolorized during processing. The dye particles provide an average density of greater than 3.0 over a spectral range of above 320 nm over which the silver halide exhibits an absorption coefficient of at least 0.5 $cm^{1}$.

PROBLEM TO BE SOLVED

Although Baugher et al, cited above, has provided a viable solution for allowing direct radiographic elements to be handled in ambient light (thereby dispensing with dark rooms and safelights), in a number of instances minimum density (fog) has continued to remain at higher levels than desired.

Thus, this invention has as one of its principal objectives to combine the capability of ambient light handling of direct X-ray imaging elements with further reductions in minimum density levels.

SUMMARY OF THE INVENTION

Based on further investigation of the problem of elevated fog levels of direct radiographic elements containing one or more dyes capable of absorbing light in the native sensitivity wavelength range of the silver halide grains when the elements are handled in room light, it has been discovered that the problem is limited to direct radiographic elements in which the grains have been sulfur sensitized. This has in turn led to the discovery that minimum densities resulting from post exposure handling in ambient light can be eliminated by employing in the hydrophilic colloid layer unit containing the X-radiation recording silver halide grains additional dye capable of increasing the density of the radiographic element to at least 3.0 over a wavelength range of at least 600 to 650 nm, not previously recognized to contribute to elevated minimum density formation.

In one aspect this invention is directed to a direct X-ray element comprised of a support and, coated on the support, at least one processing solution permeable hydrophilic colloid layer unit containing silver halide grains sensitive to X-radiation, wherein the silver halide grains sensitive to X-radiation are sulfur sensitized and the hydrophilic colloid layer unit contains a combination of processing solution bleachable dyes chosen to provide prior to processing (a) an average density of greater than 3.0 over a first, continuous spectral sensitivity range extending from a minimum wavelength of 320 nm over which the silver halide grains exhibit an absorption coefficient of at least 0.5 $cm^{-1}$ and (b) a density of greater than 3.0 throughout a second spectral range including wavelengths of from 600 to 650 nm.

DESCRIPTION OF PREFERRED EMBODIMENTS

In the simplest possible construction a direct radiographic element according to the invention can take the following form:

| DXR-1 |
|---|
| Hydrophilic Colloid Layer Unit |
| Support |

The support can take the form of any conventional radiographic element support. It can be either light reflective or transmissive. A single hydrophilic colloid layer unit is particularly compatible with rigid supports (e.g., a glass or metal plate), since a rigid support can withstand the forces applied to the support by the hydrophilic colloid layer unit that would otherwise cause a flexible support to curl. In the simplest possible construction the hydrophilic colloid layer unit consists of a single silver halide emulsion layer. In all embodiments in which silver halide emulsion is coated on only one side of the support, the support can be either X-radiation transmissive or X-radiation absorbing.

Since flexible supports (e.g., film and paper supports) are much more common than rigid supports, usually two hydrophilic colloid layer units are coated on the support, as shown in the following construction:

| DXR-2 |
|---|
| Hydrophilic Colloid Layer Unit |
| Support |
| Hydrophilic Colloid Layer Unit |

In DXR-2 one or both of the hydrophilic colloid layer units can be a silver halide emulsion layer. Coating physical property modifying addenda can be present in either or both of the hydrophilic colloid layer units. When only one of the hydrophilic colloid layer units is a silver halide emulsion layer, the support is a light reflective or transmissive flexible support and the remaining hydrophilic colloid layer unit functions as an anticurl layer. When both of the hydrophilic colloid layer units is a silver halide emulsion layer, the support can be either flexible or rigid, but must be X-radiation and light transmissive.

In a preferred variant of the constructions, instead of hydrophilic colloid layer units consisting of a silver halide emulsion layer, the hydrophilic colloid layer unit can contain two or more layers, with at least one of these layers being a silver halide emulsion layer. For example, each silver halide emulsion layer described above can be divided into two or three silver halide emulsion layers. In a preferred form each hydrophilic colloid layer unit containing a silver halide emulsion is comprised of a silver halide emulsion layer and at least one overlying protective layer.

The following represents a specifically preferred form of the invention having broad general applicability:

| DXR-3 |
|---|
| Protective Overcoat |
| Emulsion Layer |
| Transparent Film Support |
| Emulsion Layer |
| Protective Overcoat |

Each emulsion layer can be sub-divided into two or more emulsion layers and each protective overcoat can be sub-divided. Protective overcoats are typically sub-divided into surface overcoats and interlayers.

The supports for the direct X-ray elements of the invention can be chosen from among those disclosed by *Research Disclosure*, Item 38957, cited above, XV. *Supports and Research Disclosure*, Vol. 184, August 1979, Item 18431, XII. Film Supports. In the majority of applications the support is a transparent film support. In its simplest possible form the transparent film support consists of a transparent film chosen to allow direct adhesion of the hydrophilic colloid emulsion layers. More commonly, the transparent film is itself hydrophobic and subbing layers are coated on the film to facilitate adhesion of the hydrophilic emulsion layers. Typically the support is either colorless or blue tinted, tinting dye being present in one or both of the film and the subbing layers. Referring to *Research Disclosure*, Item 38957, Section XV. Supports, cited above, attention is directed particularly to paragraph (2), which describes subbing layers, and paragraph (7), which describes preferred polyester film supports.

The silver halide emulsions contain silver halide grains responsive to X-radiation. Silver halide grain compositions contemplated include silver bromide, silver iodobromide, silver chlorobromide, silver iodochlorobromide, silver chloroiodobromide, silver chloride, silver iodochloride, silver bromochloride and silver iodobromochloride, where halides are named in order of ascending concentrations. Iodide is limited to less than 3 mole percent iodide to facilitate more rapid processing. Preferably iodide is limited to less than 1 mole percent, based on silver, or eliminated entirely from the grains.

Silver halide coating coverages determine maximum density and are a factor influencing imaging speed and granularity. For dental imaging and most, but not all, other imaging applications the silver halide grain coating coverages are chosen to provide an overall maximum density of at least 3.5 and preferably at least 4.0 following imagewise exposure and processing. Depending upon the specific type of emulsion chosen and the presence or absence of covering power enhancing components, silver coating coverages in each emulsion layer, assuming identical emulsion layers on opposite sides of the support, can range from 5.0 to 30 g/m$^2$, but more typically range from 7.5 to 25 g/m$^2$.

The silver halide emulsions can take the form of either tabular or nontabular grain emulsions, where a tabular grain emulsion is defined as one in which tabular grains account for greater than 50 percent of total grain projected area. Conventional emulsions in use in radiographic elements prior to the use of tabular grain emulsions are disclosed in *Research Disclosure*, Item 18431, cited above, 1. Silver Halide Emulsions, and include single-jet emulsions and continuously precipitated double-jet emulsions, ammoniacal emulsions, and thiocyanate or thioether ripened emulsions.

Preferred emulsions are tabular grain emulsions. The following, here incorporated by reference, are representative of conventional tabular grain emulsions of the varied halide compositions set out above:

| | |
|---|---|
| Wilgus et al | U.S. Pat. No. 4,434,226; |
| Kofron et al | U.S. Pat. No. 4,439,520; |
| Wey et al | U.S. Pat. No. 4,414,306; |
| Maskasky | U.S. Pat. No. 4,713,320; |
| Maskasky | U.S. Pat. No. 4,713,323; |
| Saitou et al | U.S. Pat. No. 4,797,354; |
| Tsaur et al | U.S. Pat. No. 5,147,771; |
| Tsaur et al | U.S. Pat. No. 5,147,772; |
| Tsaur et al | U.S. Pat. No. 5,147,773; |
| Tsaur et al | U.S. Pat. No. 5,171,659; |
| Maskasky et al | U.S. Pat. No. 5,176,992; |
| Maskasky | U.S. Pat. No. 5,178,997; |
| Maskasky | U.S. Pat. No. 5,178,998; |
| Maskasky | U.S. Pat. No. 5,183,732; |
| Maskasky | U.S. Pat. No. 5,185,239; |
| Tsaur et al | U.S. Pat. No. 5,210,013; |
| Tsaur et al | U.S. Pat. No. 5,221,602; |
| Tsaur et al | U.S. Pat. No. 5,252,453; |
| Maskasky | U.S. Pat. No. 5,264,337; |
| Maskasky | U.S. Pat. No. 5,292,632; |
| House et al | U.S. Pat. No. 5,320,938; |
| Maskasky | U.S. Pat. No. 5,399,478; |
| Maskasky | U.S. Pat. No. 5,411,852. |

Preferred tabular grain emulsion selections for use in the emulsion layers are those disclosed by Zietlow U.S. Pat. No. 5,370,977, the disclosure of which is here incorporated by reference. Tabular grains are recognized to provide superior covering power (Dmax÷silver coating coverage). It is therefore preferred to employ tabular grain emulsions in which tabular grains account for at least 75 (and optimally at least 90) percent of total grain projected area Tabular grain emulsions have been reported in which substantially all (>98% of total grain projected area) of the grains are tabular.

Tabular grain emulsions are known to be useful in mean equivalent circular diameter (ECD) sizes of up to 10 $\mu$m. For dental imaging, the maximum average ECD is halved (i.e., up to 5 $\mu$m) in the interest of reducing granularity (image noise). Further, it is preferred that the maximum average ECD of the tabular grains be less than 3.0 $\mu$m.

Limiting the average ECD of the tabular grains and their thickness, reduces the silver content per grain. This allows the number of grains for a given silver coating coverage to be increased, which translates into reduced granularity. It is contemplated to employ tabular grains that exhibit average thicknesses of less than 0.3 $\mu$m and preferably less than 0.2 $\mu$m. Ultrathin (<0.07 $\mu$m in average thickness) tabular grain emulsions are known and can be employed, but, to avoid warm image tones, it is preferred that the tabular grains have an average thickness of at least 0.1 $\mu$m.

The tabular grains preferably exhibit at least an intermediate average aspect ratio (i.e., an average aspect ratio of at least 5). Average aspect ratio (AR) is the quotient of average ECD divided by average tabular grain thickness (t):

$$AR=ECD\div t$$

High (>8) average aspect ratios ranging up to 50 or more are preferred. Optimum average aspect ratios are in the range of from 10 to 35.

The tabular grain emulsions employed in the elements of the invention are in all instances sulfur sensitized. Gelatin naturally containing sulfur components capable sensitizing silver halide grains, commonly referred to as active gelatin, was originally relied upon to impart sensitivity to silver halide grains. Following the discovery of the role of the natural sulfur components of gelatin in sensitizing silver halide grains, sulfur sensitizers were developed for addition and most gelatin now employed as peptizers is itself inactive (lacks any sensitizing capability). A general discussion of sulfur sensitizers and their mechanism of sensitization is provided by Harbison and Spencer in Chapter 5. Chemical Sensitization and Environmental Effects, particularly Section C. Sulfur Sensitization, of James *The Theory of the Photographic Process,* 4th Ed., Macmillan, New York, 1977. Conventional sulfur sensitizers as well as noble metal (e.g., gold) and reduction sensitizers commonly employed in combination with sulfur sensitizers are disclosed in *Research Disclosure*, Item 38957, cited above, Section IV. Chemical sensitization. This section also discloses the silver halide solvents, such as thioethers and thiocyanates, frequently employed in combination with sulfur sensitizers. Common sulfur sensitizers include thiosulfates ,thiosulfonates, thiocyanates, isothiocyanates, thioethers, thioureas, cysteine and rhodanine. Thiosulfates are common sulfur sensitizers. More recently thioureas have found extensive use as sulfur sensitizers. The following, here incorporated by reference, are illustrative of more recent sulfur sensitizers:

| | |
|---|---|
| Mifune et al | U.S. Pat. No. 4,276,374; |
| Yamashita et al | U.S. Pat. No. 4,746,603; |
| Herz et al | U.S. Pat. No. 4,749,646; |
| Burgmaier et al | U.S. Pat. No. 4,180,626; |
| Ogawa | U.S. Pat. No. 4,786,588; |
| Ono et al | U.S. Pat. No. 4,847,187; |
| Okurmura et al | U.S. Pat. No. 4,863,844; |
| Shibahara | U.S. Pat. No. 4,923,793; |
| Chino et al | U.S. Pat. No. 4,962,016; |
| Kashi | U.S. Pat. No. 5,002,866; |
| Yagi et al | U.S. Pat. No. 5,004,680; |
| Kajiwara et al | U.S. Pat. No. 5,116,723; |
| Lushington et al | U.S. Pat. No. 5,168,035; |
| Takiguchi et al | U.S. Pat. No. 5,198,331; |
| Patzold et al | U.S. Pat. No. 5,229,264; |
| Mifune et al | U.S. Pat. No. 5,244,782. |

For direct X-ray imaging it is generally preferred to employ sulfur sensitization in combination with gold sensitization. Since the silver halide grains are intended to respond to X-radiation exposure rather than light exposure, the silver halide grains are not spectrally sensitizing. This sets the silver halide grain employed for direct X-ray imaging apparent from the overwhelming majority of silver halide grains employed for indirect X-ray imaging.

Other conventional features of preferred emulsion layers of the direct X-ray elements of the invention are disclosed both in Item 38957, cited above, which is directed to silver halide emulsion technology generally, and in Item 18431, cited above, the disclosure of which is directed specifically to radiographic elements. The emulsion grains can be internally doped as disclosed in Item 38957, Section I, sub-section D, and Item 18431, Section I, sub-section C. The emulsions can contain antifoggants and stabilizers, as disclosed in Item 38957, Section VII, and Item 18431, Section II.

A general description of vehicles and vehicle extenders and hardeners for the emulsion and protective overcoat layers of the direct X-ray elements are disclosed by Item 38957, Section II. Gelatin (including gelatin derivatives, such as acetylated gelatin and phthalated gelatin) constitute preferred grain peptizers and hydrophilic colloid layer vehicles. The use of cationic starch as peptizers for tabular grain emulsions is taught by Maskasky U.S. Pat. Nos. 5,620,840 and 5,667,955.

To allow the direct X-ray elements of the invention to be handled in ambient light while controlling minimum density, it is specifically contemplated to incorporate light-absorbing dyes in the hydrophilic colloid layer units containing X-radiation responsive silver halide grains. One or a combination of these light-absorbing dyes is chosen to intercept light of a wavelength to which the silver halide grains possess native sensitivity. James *The Theory of the Photographic Process,* 4th Ed., Macmillan, New York, 1977, Fig. 1.16, p. 39, discloses the absorption coefficient of silver halides of varied compositions over the spectral region of from 220 to 580 nm. In the direct X-ray elements of the invention light absorption of the hydrophilic colloid vehicle at wavelengths of 320 nm and shorter protects the silver halide grains from unwanted light exposure. For silver chloride grains this leaves an "at risk" spectral range of native sensitivity of from 320 to 420 nm in which its absorption coefficient exceeds 0.5 $cm^{-1}$ (i.e., it exhibits significant light absorption) and the silver chloride grains receive no significant protection from light exposure by the hydrophilic colloid vehicle. For silver bromide the corresponding at risk spectral range is from 320 to 450 nm. For silver iodobromide containing 3 mole percent iodide, based on silver, the corresponding at risk spectral range of native sensitivity is from 320 to 540 mn.

It has been discovered that sulfur sensitization of the silver halide grains creates an additional, longer wavelength spectral region of sufficient sensitivity to contribute to increased minimum density upon handling direct X-ray elements under ordinary (not safelight) ambient lighting conditions, even when the grains have been protected from ambient light exposure in their spectral region of native sensitivity. The significant sensitivity in this longer wavelength region extends from 600 to 700 nm, with the principal sensitivity extending from 600 to 650nm.

To protect the sulfur sensitized silver halide grains from exposure to ambient light in both the at risk native region of sensitivity and the longer wavelength region of sensitivity, it is necessary to employ a combination of dyes, since no single dye exhibits high levels of absorption over the wavelength span of from 320 to 700 nm or even 320 to 650 nm. To provide adequate protection against unwanted light exposure of the silver halide grains during handling of the direct X-ray element it is contemplated to choose the dyes and incorporate them in an amount sufficient dye to impart to the element an average density of at least 3.0 over the at risk region of native sensitivity and a density of at least 3.0 over the longer wavelength region 600 to 650 nm of principal sensitivity and preferably over the wavelength region 600 to 700 nm of significant sensitivity.

For absorption efficiency it is preferred to employ dyes that each exhibit a maximum absorption wavelength ($\lambda$max) within one of the at risk spectral regions. It is generally preferred that the dyes exhibit half-peak 20 bandwidths that together occupy the entire at risk spectral regions. The "half-peak bandwidth" of a dye is the spectral region over which its absorption is equal to at least half of its absorption. Since a single dye rarely exhibits a half-peak bandwidth of longer than 150 nm, it is appreciated that two or more dyes are required to provide half-peak bandwidth overlap of the at risk native sensitivity region. The 50 nm range of longer wavelength principal sensitivity and even the 100 nm range of longer wavelength significant sensitivity can more easily be entirely overlapped by the half-peak bandwidth of a single dye. However, since sensitivity, albeit dimished, continues beyond the longer wavelength region limits named above, it is preferred to choose combinations of dyes for the longer wavelength region, allowing high levels of absorption to be achieved within the longer wavelength region and significant levels of absorption to be achieved in adjacent wavelength regions—e.g., beyond 700 nm.

The dyes incorporated for protection in the at risk region of native silver halide grain sensitivity include near ultraviolet absorbers and yellow dyes. For iodide containing silver halide grains red dyes (blue and green absorbing) are contemplated. A combination of one or more ultraviolet absorbers, yellow dyes and magenta dyes is also contemplated.

The dye or dyes incorporated for protection in the longer wavelength region of silver halide grain sensitivity can be cyan dyes. It is also contemplated to incorporate blue dye to serve this function.

The dyes can be usefully located either in the silver halide emulsion layer of a hydrophilic colloid layer unit or in a protective layer lying between emulsion layer to be protected and the light source (e.g., in a protective layer). Light interception is most efficiently realized when at least a major portion (>50%) of the dye is located in a hydrophilic colloid layer unit protective layer overlying the emulsion layer or layers. Surprisingly, the lowest attainable minimum densities are realized when from 60 to 85 percent of each dye in the hydrophilic colloid layer unit is located in an overlying protective layer and from 15 to 40 percent of the dye is located directly within the emulsion layer or layers. preferred to yellow dyes.

In dual-coated indirect X-ray elements dyes are commonly incorporated to reduce crossover (light crossing through the support during imagewise exposure to expose an emulsion layer on the opposite the support), and, in single-sided indirect X-ray elements and photographic elements, dyes are commonly incorporated to reduce halation. These crossover control and antihalation dyes are chosen to be processing solution bleachable and, preferably, processing solution decolorizable.

To reduce contact of these dyes with the surfaces of the silver halide grains, thereby reducing sensitivity of the silver halide grains, it is common practice in these elements intended for imagewise exposure by light to choose particulate dyes. By maintaining the dyes in particulate form prior to processing, the mobility of the dyes is effectively eliminated. Processing solution bleachable particulate dyes satisfying the absorption requirements of this invention can be selected from among conventional crossover control and antihalation dyes. Such conventional dyes and processes for their density reduction (i.e., bleaching or decolorization) are generally disclosed in *Research Disclosure*, Item 38757, cited above, Section VIII. Absorbing and scattering materials, B. Absorbing materials.

Specific examples of processing solution decolorizable particulate dyes useful in the practice of this invention are provided by Diehl et al U.S. Pat. Nos. 4,092,168, 4,940,654, 4,950,586, 4,994,356 and 5,213,956, Factor et al U.S. Pat. Nos. 4,900,653 and 4,948,718, Anderson et al U.S. Pat. No. 4,988,611, Usagawa et al U.S. Pat. No. 5,208,137, Adachi U.S. Pat. No. 5,213,957 and Usami U.S. Pat. No. 5,238,798, the disclosures of which are here incorporated by reference.

In the direct X-ray elements of the invention any light desensitization that occurs as a result of the dyes migrating to the surface of the silver halide grains is an advantage rather than a liability, as in the case of indirect X-ray elements. Therefore, there is no reason to restrict dye selections to microcrystalline dyes. Soluble and mobile dyes can also be coated in the hydrophilic colloid layer units for ambient light protection. Soluble dyes offer the advantage of producing higher densities at lower coating concentrations than microcrystalline dyes where soluble and microcrystalline dyes with similar chromophoric unites are compared.

The following are specific illustrations of processing solution bleachable dyes, including their peak absorptions (λmax) and half peak bandwidth (bw) in nm, that can be incorporated singly or in combination to protect the direct X-ray elements of the invention from exposure in the at risk region of native sensitivity of the silver halide grains:

| | |
|---|---|
| NPD-1 | Bis[1-(4-carboxyphenyl)-3-methyl-2-pyrazolin-5-one-4]monomethineoxonol ($\lambda_{max}$ 365; bw 90) |
| NPD-2 | 4-(4-Dimethylaminobenzylidene)-1-(4-carboxyphenyl)-3-methyl-2-pyrazolin-5-one ($\lambda_{max}$ 450; bw 135) |
| NPD-3 | 1-(4-Carboxyphenyl)-4-(4-diethylaminobenzylidene)-3-methyl-2-pyrazolin-5-one ($\lambda_{max}$ 450; bw 150) |
| NPD-4 | 1-(3,5-Dicarboxyphenyl)-4-(4-dimethylaminobenzylidene)-3-phenyl-2-pyrazolin-5-one ($\lambda_{max}$ 470; bw 160) |
| NPD-5 | 2-Cyano-3-(4-hydroxypehenyl-2-propenoate ($\lambda_{max}$ 470; bw 160) |
| NPD-6 | 1-(4-Carboxyphenyl-4-(4-diethylaminobenzyldene)-3-methyl-2-pyrazolin-5-one ($\lambda_{max}$ 490; bw 180) |
| NPD-7 | 1-(3,5-Dicarboxyphenyl)-4-(4-dimethylaminocinnamylidene)-3-methyl-2-pyrazolin-5-one ($\lambda_{max}$ 443; bw 130) |
| NPD-8 | 1-(4-Carboxyphenyl)-4-dimethylaminocinnamylidene)-3-methyl-2-pyrazolin-5-one ($\lambda_{max}$ 443; bw 70) |
| NPD-9 | 3-Carboxy-4-(4-dimethylaminobenzylidene)-1-phenyl-2-pyrazolin-5-one ($\lambda_{max}$ 454; bw 170) |
| NPD-10 | 1-butyl-3-carboxymethyl-5-(dimethylaminobenzylidene)barbituric acid ($\lambda_{max}$ 478; bw 120) |

The following are specific illustrations of processing solution bleachable dyes, including their peak absorptions (λmax) and half peak bandwidth in mn, that can be incorporated singly or in combination to protect the direct X-ray elements of the invention from exposure in the longer wavelength region of sensitivity created by sulfur sensitization of the silver halide grains:

| | |
|---|---|
| LPD-1 | Bis[3-acetyl-1-(2,5-disulfophenyl)-2-pyrazolin-5-one-(4)]pentamethineoxonol, pentasodium salt ($\lambda_{max}$ 671; bw 75) |
| LPD-2 | Bis[3-methyl-1-(2,5-disulfophenyl)-2-pyrazolin-5-one-(4)]pentamethineoxonol, pentasodium salt ($\lambda_{max}$ 637; bw 102) |

-continued

| | |
|---|---|
| LPD-3 | Bis[3-methyl-1-(4-sulfophenyl)-2-pyrazolin-5-one-(4)]meso-pentamethineoxonol, trisodium salt ($\lambda_{max}$ 665; bw 105) |
| LPD-4 | Bis[3-carboxy-1-(3-sulfopropyl)-2-pyrazolin-5-one-(4)]pentamethineoxonol, pentasodium salt ($\lambda_{max}$ 650; bw 107) |
| LPD-5 | Bis[3-carboxy-1-(2,5-disulfopropyl)-2-pyrazolin-5-one-(4)]pentamethineoxonol, heptasodium salt ($\lambda_{max}$ 656; bw 100) |
| LPD-6 | Bis[3-ethyoxycarbonyl-1-(4-sulfophenyl)-2-pyrazolin-5-one-(4)]pentamethineoxonol, trisodium salt ($\lambda_{max}$ 672; bw 95) |
| LPD-7 | Bis[3-carbamoyl-1-(4-sulfophenyl)-2-pyrazolin-5-one-(4)]pentamethineoxonol, pentasodium salt ($\lambda_{max}$ 663; bw 103) |
| LPD-8 | 1-(4-Carboxyphenyl)-4-dimethylaminocinnamylidene)-3-methyl-2-pyrazolin-5-one ($\lambda_{max}$ 610; bw 180) |
| LPD-9 | Bis{[(1,3,3-tri-cyano)-2-(4-methylsulfonamido)phenyl]propene}trimethine oxonol, triethylammonium salt ($\lambda_{max}$ 620; bw 110) |
| LPD-10 | 4-(4,5-Dihydro-4-(5-(5-hydroxy-3-methyl-1-(4-sulfophenyl)-1H-pyrazoyl-4-yl)-2,4-pentadienylidene)-3-methyl-5-oxo-1H-pyrazol-1-yl)-1-yl)-benzenesulfonic acid ($\lambda_{max}$ 626; bw 100) |

The protective dyes identified above are capable of reducing the sensitivity of the silver halide grains to ambient light by about 3.0 log E, where E is exposure is lux-seconds. The light sensitivity of the silver halide grains can, if desired, be additionally reduced by from 0.3 to 0.6 log E by adsorbing a "desensitizer" to the surfaces of the X-ray responsive silver halide grains. The term "desensitizer" is employed in its ordinary photographic usage to indicate a material that reduces the sensitivity of an emulsion to light exposures. Conventional desensitizers employed in photography and, occasionally, in indirect radiography do not reduce the absorption of X-radiation and hence do not reduce the sensitivity of the emulsions to X-radiation exposures. Conventional desensitizers that are not dyes are disclosed in *Research Disclosure*, Item 38957, Section IV, sub-section B. These desensitizers are illustrated by N,N'-dialkyl-4,4'-bispyridinium salts, nitron and its salts, thiruam disulfide, piazine, nitro-1,2,3-benzothiazole, nitroindazole and 5-mercaptotetrazole, disclosed by Peterson et al U.S. Pat. No. 2,271,229, Kendall et al U.S. Pat. No. 2,541,472, Abbott et al U.S. Pat. No. 3,295,976, Rees et al U.S. Pat. Nos. 3,184,313 and 3,403,025, Biggons et al U.S. Pat. No. 3,922,545, Sumi et al U.S. Pat. No. 4,666,827 and Uesawa et al U.S. Pat. No. 4,840,889, the disclosures of which are here incorporated by reference.

It is also possible to employ as a desensitizer a methine dye, such as a cyanine or merocyanine dye, having one or more desensitizing nuclei. Typical heterocyclic nuclei featured in cyanine and merocyanine dyes well-suited for use as desensitizers are derived from nitrobenzothiazole, 2-aryl-1-alkylindole, pyrrolo[2,3-b]pyridine, imidazo[4,5-b]quinoxaline, carbazole, pyrazole, 5-nitro-3H-indole, 2-arylbenzindole, 2-aryl-1,8-trimethyleneindole, 2-heterocyclylindole, pyrylium, benzopyrylium, thiapyrylium, 2-amino-4-aryl-5-thiazole, 2-pyrrole, 2-(nitroaryl)indole, imidazo[1,2-a]pyridine, imidazo[2,1-b]thiazole, imidazo[2,1-b]-1,3,4-thiadiazole, imidazo[1,2-b]pyridazine, imidazo[4,5-b]quinoxaline, pyrrolo[2,3-b]quinoxaline, pyrrolo[2,3-b]pyrazine, 1,2-diarylindole, 1-cyclohexylpyrrole and nitrobenzoselenazole. Such nuclei can be further enhanced as desensitizers by electron-withdrawing substituents such as nitro, acetyl, benzoyl, sulfonyl, benzosulfonyl and cyano groups. Desensitizing dyes containing nuclei of these types are illustrated by Kendall U.S. Pat. No. 2,293,261, Coenen et al U.S. Pat. No. 2,930,694, Brooker et al U.S. Pat. No. 3,431,111, Mee et al U.S. Pat. Nos. 3,492,123, 3,501,312 and 3,598,595, Illingsworth et al U.S. Pat. No. 3,501,310, Lincoln et al U.S. Pat. No. 3,501,311, VanLare U.S. Pat. No. 3,615,608, Carpenter et al U.S. Pat. No. 3,615,639, Riester et al U.S. Pat. No. 3,567,456, Jenkins U.S. Pat. No. 3,574,629, Jones U.S. Pat. No. 3,579,345, Mee U.S. Pat. No. 3,582,343, Fumia et al U.S. Pat. No. 3,592,653 and Chapman U.S. Pat. No. 3,598,596.

An alternative to employing a desensitizer adsorbed to the grain surfaces, as described above, it is also recognized that emulsion addenda that induce low intensity reciprocity failure can be incorporated in the emulsion layer or layers, as disclosed by Kitchin et al, U.S. Pat. No. 4,472,497, the disclosure of which is here incorporated by reference.

The protective overcoat overlying each emulsion layer is comprised of a hydrophilic colloid vehicle, chosen from among the same types disclosed above in connection with the emulsion layers. In conventional radiographic elements protective overcoats are provided to perform two basic reasons: First, to provide a layer between the emulsion layer and the surface of the element for physical protection of the emulsion layer during handling and processing. Second to provide a convenient location for the placement of addenda, particularly those that are intended to modify the physical properties of the radiographic element. The protective overcoats of the direct X-ray elements of this invention can perform both these basic functions. The protective overcoats can include the features disclosed by *Research Disclosure*, Item 18431, cited above, IV. Overcoat Layers, and can also include addenda (including coating aids, plasticizers and lubricants, antistats and matting agents) disclosed by *Research Disclosure*, Item 38957, IX. Coating physical property modifying addenda.

The hydrophilic colloid coating coverages range from the minimum amount required to assure coating uniformity, typically regarded as at least 50 percent of the weight of the total particulate matter. The particulate matter can consist of only the silver halide grains. Matting beads present in the protective layer also contribute to particulate matter. As previously noted, the protective dyes can be particulate form as well.

Increasing the coating coverages of hydrophilic colloid does not adversely affect imaging properties, but can have the effect of increasing processing times. It is therefore usually preferred to limit the weight ratio of hydrophilic colloid to particles in each layer to 2:1 or less. Typically the total thickness of the hydrophilic colloid layers on each side of the support ranges from about 3 to 7 $\mu$m, most typically from about 4 to 6 $\mu$m.

Exposure and processing of the direct X-ray elements of the invention can be undertaken in any convenient conventional manner. The exposure and processing techniques of Zietlow U.S. Pat. No. 5,370,977, cited and incorporated by reference above, are typical of dental direct X-ray films. The exposure and processing techniques of Lyons et al U.S. Pat. Nos. 4,480,024 and 4,707,435, here incorporated by reference, are typical of industrial direct X-ray elements.

EXAMPLES

The invention can be better appreciated by reference to the following specific embodiments. All coating coverages shown in parenthesis are in units of g/m$^2$, except as otherwise indicated. Coating coverages of silver halide are reported in terms of silver.

Control Film A

The general configuration of the film was as shown above for DXR-3.

Overcoat:

| | |
|---|---|
| Gelatin | (1.35) |
| NPD-1 | (0.48) |
| NPD-2 | (0.16) |
| Poly(methyl methacrylate) | (0.09) |

-continued

| | |
|---|---|
| SF-1 | (0.08) |
| SF-2 | (0.008) |

SF-1 was a mixture of 4-octyphenoxy-$(C_2H_4—O)_xH$ (x~3) and 4-octylphenoxy-$(C_2H_4—O)_2C_2H_4SO_3Na$.

SF-2 was a mixture of $$RfC_2H_4SCH(CO_2H)CH_2CONH(CH_2)_3—N(CH_3)_2$$

and $$RfC_2H_4SCH(CH_2CO_2H)CONH(CH_2)_3—N(CH_3)_2$$

Rf is a mixture of $C_6H_{13}$, $C_8F_{17}$ and $C_{10}F_{21}$

Each Emulsion Layer: AgBr tabular grain emulsion in which tabular grains accounted for greater than 50 percent of total grain projected area. The mean grain ECD was 1.8 $\mu$m and the mean thickness of the tabular grains was 0.13 $\mu$m. The BWM latex polymer was poly(n-butyl acrylate-co-isopropylmethacrylamide-co-rnethylacrylamide). The APMT was a 1-(3-acetamidophenyl-5-mercapto) tetrazole. The MeS-TAI was 4-hydroxy-6-methyl-2-methylmercapto-1,3,3a,7-tetraazaindene.

| | |
|---|---|
| AgBr | (7.56) |
| Gelatin | (4.9) |
| Dextran | (1.5) |
| BWM latex polymer | (1.1) |
| Sorbitol | (0.6) |
| MeS-TAI | (2.1 g/Ag mole) |
| Catechol disulfide | (0.2) |
| APMT | (0.01) |
| NPD-1 | (0.16) |
| NPD-2 | (0.11) |
| 6-Chloro-4-nitrobenzotriazole | (0.0021) |
| Potassium tetrachloroaurate | ($1 \times 10^{-5}$) |

Transparent Film Support: A blue tinted poly(ethylene terephthalate) film having a 178 $\mu$m thickness and coated with conventional subbing layers. The Protective Overcoat and Emulsion Layers were both hardened by adding to each Emulsion Layer bis(vinylulfonylmethyl)ether hardener in a concentration of 2.4 percent by weight, based on the gelatin in both the Emulsion Layer and the Protective Overcoat.

Chemical Sensitization

The AgBr emulsions used in Film A were sulfur and gold sensitized using the following chemicals, bracketed amounts are in units of mg/Ag mole:

4,4'-phenyl disulfide diacetanilide [0.5]

potassium tetrachloroaurate [3.3]

sodium thiocyanate [150]

5,6-dimethyl-3(3-sulfopropyl)benzothiazolium inner salt [20]

sodium thiosulfate [1.66]

potassium selenocyanate [0.44]

Chemical sensitization was done by adding these chemicals in sequential order at 40° C. and heating to 60° C. at a rate of 5° C. per 3 minutes and then held at 60° C. for 15 minutes. After the appropriate digestion, the emulsion is chilled rapidly with stirring until set.

Films B–F were chemically sensitized and constructed as in Film A, except the chemical sensitization was varied as indicated in Table I.

Table I shows the effect of varying sulfur levels and extent of digestion on direct X-ray speed and fog when handled using Kodak GBX™ safelights or handled under roomlight (2 minutes @ 500 Lux cool white fluorescent lighting at 71 cm).

X-ray exposures were in each instance undertaken with a Phillips MG324 generator operated at 80 kVp with 0.6 mm Al filtration varying either current or time. Sensitometric gradations in exposures were achieved by using a 21 increment (0.1 log E) aluminum step wedge of varying thickness.

Processing was undertaken using a Kodak RP X-Omat™ rapid access processor. The following developer composition was employed:

| | |
|---|---|
| Hydroquinone | 30 g |
| 4-Hydroxymethyl-4-methyl-1-phenyl-3-pyrazolidinone | 1.5 g |
| Potassium hydroxide | 21 g |
| Sodium bicarbonate | 7.5 g |
| Potassium sulfite | 44.2 g |
| Sodium bromide | 35 g |
| 5-Methylbenzotriazole | 0.06 g |
| Glutaraldehyde | 4.9 g |
| Water to 1 liter/pH 10 | |

TABLE I

| Film | Sulfur Sens.* | Digestion Time (min) | Speed | Dark Fog | Roomlight Fog |
|---|---|---|---|---|---|
| A | 1.66 | 15 | 252 | 0.20 | 1.38 |
| B | 1.66 | 30 | 263 | 0.20 | 1.83 |
| C | 3.3 | 15 | 268 | 0.19 | 2.34 |
| D | 3.3 | 30 | 274 | 0.19 | 3.93 |
| E | 0.83 | 15 | 224 | 0.20 | 0.38 |
| F | 0.83 | 30 | 234 | 0.20 | 0.92 |

*level of sulfur sensitizer introduced in mg/Ag mole

From Table I it is apparent that increasing the digestion times at all sulfur levels increased both the speed as well as the roomlight fog while not influencing at all fog values for film handled under dark conditions. Doubling the sulfur levels gave additional speed, but exacerbated the roomlight handling fog. Reducing the sulfur level resulted in lower roomlight fog, but unacceptably lowered speed. An optimum sulfur level was identified that gave appropriate speed and minimal roomlight fog. However, even with optimum levels of sulfur sensitizer, the roomlight fog was still objectionably high and further improvement was needed.

The problem was overcome by constructing two films identical to Film A, but with dye LPD-1 added to the overcoat in an amount of 0.11 g/m$^2$ (Film H) or 0.22 g/m$^2$ (Film I). Control Film G was prepared identically as Film A.

The results are summarized in Table II.

TABLE II

| Film | LPD-1 | Lighting/ Time (sec) | Speed | Fog |
|---|---|---|---|---|
| G | 0 | safelight (60) | 251 | 0.19 |
| G | 0 | roomlight (120) | | 0.78 |
| G* | 0 | roomlight (120) | | 1.16 |
| H | 0.11 | safelight (60) | 251 | 0.19 |
| H | 0.11 | roomlight (120) | | 0.45 |
| H* | 0.11 | roomlight (120) | | 0.51 |
| I | 0.22 | safelight (60) | 251 | 0.19 |
| I | 0.22 | roomlight (120) | | 0.37 |
| I* | 0.22 | roomlight (120) | | 0.38 |

*These films were exposed to roomlight after storage (incubation). Incubation was for 1 week at 49° C. and 50% relative humidity. The remaining films were handled and processed promptly after coating.

From Table II it is apparent that the addition of small amounts of the protective dye having a half-peak band width extending over the spectral region of 600 to 630 nm reduced fog under roomlight handling conditions.

The invention has been described in detail with particular reference to preferred embodiments thereof, but it will be understood that variations and modifications can be effected within the spirit and scope of the invention.

What is claimed is:

1. A direct X-ray element comprised of a support and, coated on the support, at least one processing solution permeable hydrophilic colloid layer unit containing silver halide grains sensitive to X-radiation,

WHEREIN the silver halide grains sensitive to X-radiation are sulfur sensitized and the hydrophilic colloid layer unit contains a combination of processing solution bleachable dyes chosen to provide prior to processing an average density of greater than 3.0 over a first, continuous spectral sensitivity range extending from a minimum wavlength of 320 nm over which the silver halide forming the grains exhibits an absorption coefficient of at least 0.5 cm$^{-1}$ and a density of greater than 3.0 throughout a second spectral range including wavelengths of from 600 to 650 nm.

2. A direct X-ray element according to claim 1 wherein the second spectral range includes wavelengths of from 600 to 700 nm.

3. A direct X-ray element according to claim 1 wherein the support is a transparent film support.

4. A direct X-ray element according to claim 3 wherein the film support is a transparent, blue tinted film support.

5. A direct X-ray element according to claim 1 wherein the silver halide grains contain less than 3 mole percent iodide.

6. A direct X-ray element according to claim 5 wherein the silver halide grains contain less than 1 mole percent iodide.

7. A direct X-ray element according to claim 6 wherein the silver halide consists of silver bromide.

8. A direct X-ray element according to claim 1 wherein the silver halide grains have an average grain equivalent circular diameter of less than 5 $\mu$m and are comprised of tabular grains having an average thickness of less than 0.3 $\mu$m accounting for more than 50 percent of total grain projected area and having an average aspect ratio of at least 5.

9. A direct X-ray element according to claim 1 wherein identical hydrophilic colloid layer units are coated on opposite sides of the support.

10. A direct X-ray element according to claim 1 wherein the processing solution bleachable dyes are coated in a water soluble form.

* * * * *